US006966727B2

(12) United States Patent
Kight et al.

(10) Patent No.: US 6,966,727 B2
(45) Date of Patent: Nov. 22, 2005

(54) APPARATUS FOR AND METHOD OF INSTALLING SEGMENTED CONCRETE PILINGS IN NEW CONSTRUCTION

(75) Inventors: Robie L. Kight, Jackson, MS (US); Mack Chunn, Madison, MS (US)

(73) Assignee: Precision Piling Systems, LLC, Ridgeland, MS (US)

( * ) Notice: Subject to any disclaimer, the term of this patent is extended or adjusted under 35 U.S.C. 154(b) by 0 days.

(21) Appl. No.: 10/937,111

(22) Filed: Sep. 8, 2004

(65) Prior Publication Data

US 2005/0111920 A1 May 26, 2005

Related U.S. Application Data

(63) Continuation-in-part of application No. 10/388,923, filed on Mar. 14, 2003, now Pat. No. 6,799,924.

(51) Int. Cl.[7] ..... E02D 7/06

(52) U.S. Cl. ..... 405/232; 405/231; 405/251; 405/252; 405/256

(58) Field of Search ..... 405/231, 232, 405/251, 252, 256; 172/810, 811, 817

(56) References Cited

U.S. PATENT DOCUMENTS

| | | | | |
|---|---|---|---|---|
| 3,238,732 A | | 3/1966 | Aas-Jakobsen | |
| 3,327,789 A | * | 6/1967 | Furuseth | 173/38 |
| 3,507,338 A | * | 4/1970 | Alexander et al. | 173/28 |
| 3,625,012 A | | 12/1971 | Thorburn | |
| 3,651,653 A | | 3/1972 | Mouton | |
| 4,139,067 A | * | 2/1979 | Craig | 173/100 |
| 4,157,230 A | | 6/1979 | Tomt et al. | |
| 4,682,659 A | * | 7/1987 | Holopainen | 173/38 |
| 4,735,527 A | | 4/1988 | Bullivant | |
| 5,032,041 A | | 7/1991 | Sinnes | |
| 5,096,333 A | | 3/1992 | Bassett | |
| 5,288,175 A | | 2/1994 | Knight | |
| 5,375,664 A | * | 12/1994 | McDowell et al. | 405/232 |
| 5,490,568 A | * | 2/1996 | Rios et al. | 405/232 |
| 5,505,561 A | | 4/1996 | Wilcox, III | |
| 5,791,820 A | * | 8/1998 | Rempel | 405/232 |
| 5,934,835 A | | 8/1999 | Whitty et al. | |
| 6,543,967 B1 | | 4/2003 | Marshall | |
| 6,609,576 B1 | * | 8/2003 | Hubbard | 173/100 |

* cited by examiner

*Primary Examiner*—Frederick L. Lagman
(74) *Attorney, Agent, or Firm*—Walker, McKenzie & Walker, P.C.

(57) ABSTRACT

An apparatus for and method of installing a pile in unstable soil before a building foundation is installed on that unstable soil. The apparatus includes a tractor; an arm pivotally attached to tractors; a mechanism for moving the arm between raised and lowered positions; a driving platform attached to the arm; and auxiliary weight attached to the front member of the arm. The method includes the steps of placing the first end of a starter pile on the unstable soil; positioning the driving platform of the tractor on the second end of the starter pile; and activating the mechanism for moving the arm between raised and lowered positions to move the arm to the lowered position and cause the driving platform to drive the starter pile into the unstable soil.

8 Claims, 4 Drawing Sheets

APPARATUS FOR AND METHOD OF INSTALLING SEGMENTED CONCRETE PILINGS IN NEW CONSTRUCTION

CROSS REFERENCE TO RELATED APPLICATIONS

This application is a continuation-in-part of application Ser. No. 10/388,923, filed Mar. 14, 2003 now U.S. Pat. No. 6,799,924, entitled "Segmented Concrete Piling Assembly with Steel Connecting Rods," now pending.

BACKGROUND OF THE INVENTION

1. Field of the Invention

The present invention relates, in general, to an apparatus for and a method of installing segmented concrete pilings before a building foundation is installed.

2. Background Art

Pre-cast concrete piles have been in use for the purpose of supporting and/or leveling existing structures for a number of years. These piles are vertically stacked one upon another and driven into the soil to a point of refusal at which a load bearing capacity may be obtained. These segmented piles, installed properly, provide greater support than a shallow method of underpinning. However, there are problems with the existing art.

In unstable soils, there is great potential for upward, downward, and lateral movement. These factors affect the integrity of the pile, as existing segmented piles have no, or very little, lateral support to prevent separation of the piles thus causing misalignment, separation of the pile, and loss of support.

Another important factor with segmented piling systems is proper alignment during installation. With no or very little lateral support between segmented piles using existing procedures, it is difficult to insure proper alignment and prevention of lateral movement during and after installation.

Knight, U.S. Pat. No. 5,288,175, issued Feb. 22, 1994, discloses a continuously reinforced segmental precast concrete underpinning pile system including a plurality of precast concrete piles and a high strength wire strand joining each of the piles.

Willcox, U.S. Pat. No. 5,505,561, issued Apr. 9, 1996, discloses a self-piloting compressible piling system including a plurality of pre-formed pile sections having bores therethrough and adapted to be arranged in end-to-end relation such that the bores are concentrically collinear, an auger plate positioned beneath the lowest of the pile sections, and a tension-bearing cable attached to the auger plate and extending through the bores of the pile sections to load the pile sections and auger plate in compression.

The known prior art has addressed only the repair of existing foundations due to shrinking of expansive soil, etc., and the resulting lack of structural support. That known prior art has relied on the weight of the existing structure to push against in order to press the pilings into the soil under the structure.

Nothing in the known prior art, either singly or in combination, discloses or suggests the present invention.

BRIEF SUMMARY OF THE INVENTION

The present invention is intended for the purpose of prevention of settlement of structures located on unstable soil and the like. The present invention provides an apparatus for and method of installing pilings on new construction before a building foundation is installed.

The apparatus for installing a pile in unstable soil before a building foundation is installed on that unstable soil includes a tractor; an arm pivotally attached to tractors; means for moving the arm between raised and lowered positions; a driving platform attached to the arm; and auxiliary weight attached to the front member of the arm.

The method of installing a pile in unstable soil before a building foundation is installed on that unstable soil includes the steps of placing the first end of a starter pile on the unstable soil; positioning the driving platform of the tractor on the second end of the starter pile; and activating the structure for moving the arm between raised and lowered positions to move the arm to the lowered position and cause the driving platform to drive the starter pile into the unstable soil.

It is an object of the present invention to provide a segmented piling system and method for underpinning new construction, before the foundation of that new construction is installed.

DETAILED DESCRIPTION OF THE INVENTION

Figure 1:
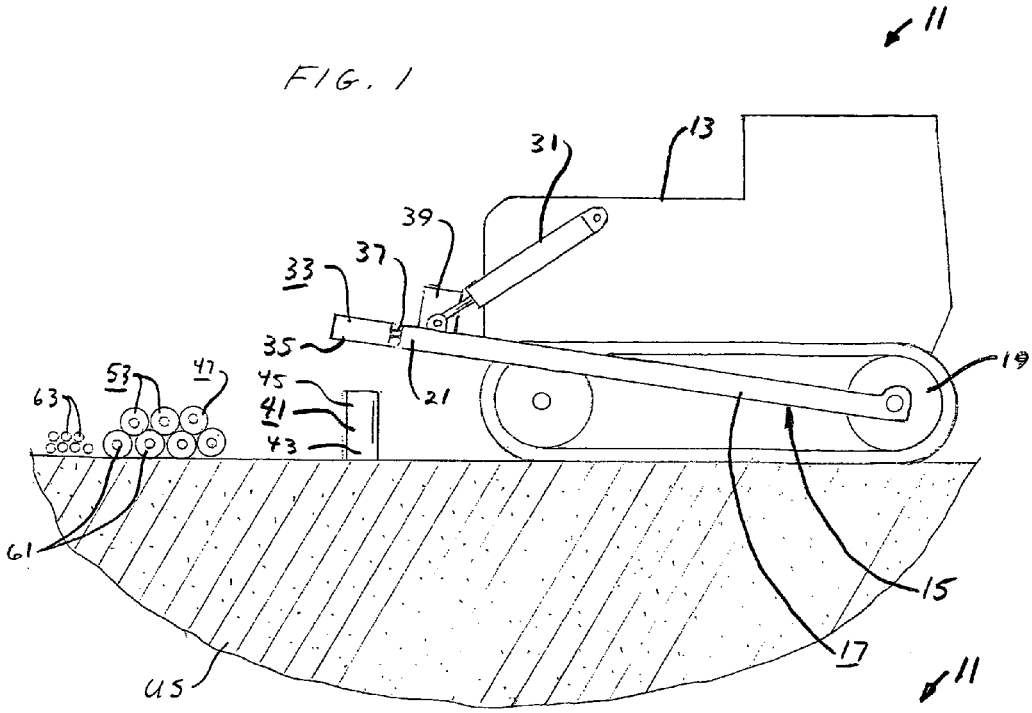
FIG. 1 is a somewhat diagrammatic side elevational view of the apparatus of the present invention, illustrating a step of the method of the present invention.
Figure 2:
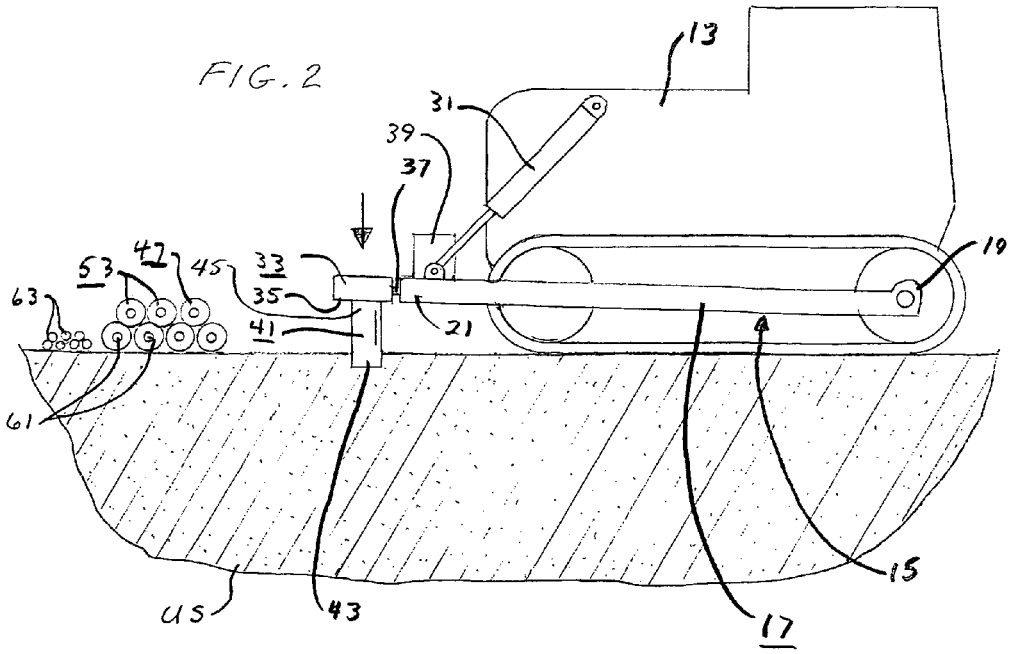
FIG. 2 is a cross-sectional view similar to FIG. 1 but illustrating a further step of the method of the present invention.
Figure 3:
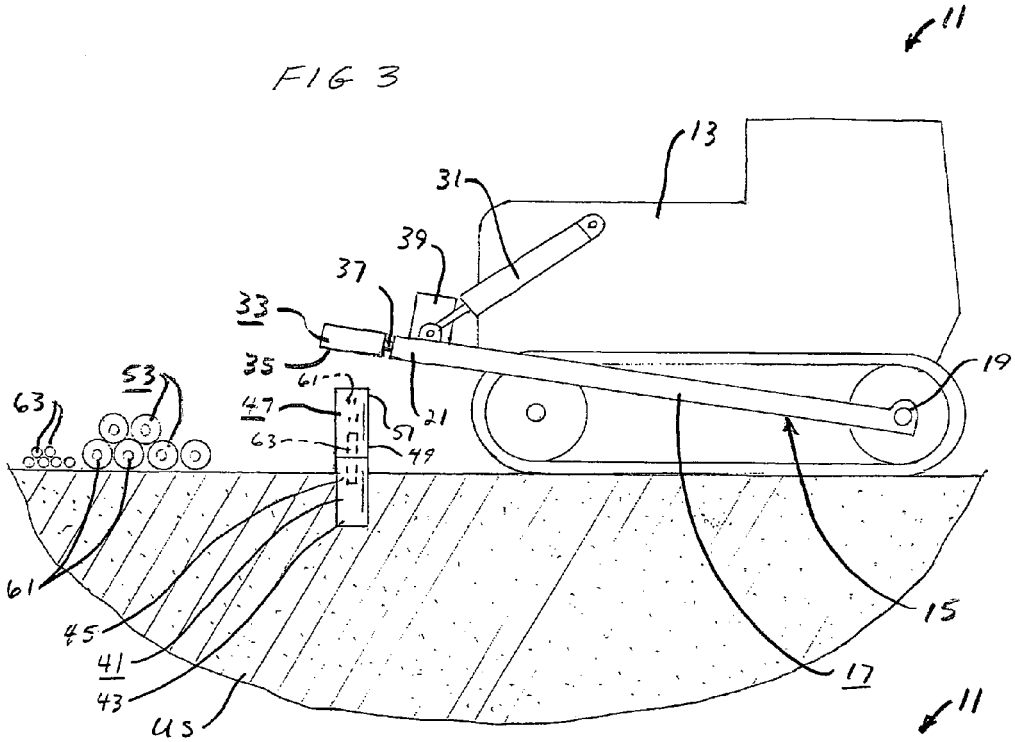
FIG. 3 is a cross-sectional view similar to FIG. 2 but illustrating a further step of the method of the present invention.

A preferred embodiment of the apparatus for and method of installing segmented concrete piling in unstable soil US before a building foundation is installed on that unstable soil US is illustrated in FIGS. 1–6, and the apparatus is identified by the numeral 11.

The apparatus 11 includes a tractor 13, such as a typical bulldozer or the like, preferably a model D-8 bulldozer manufactured by Caterpillar Inc., 100 N.E. Adams Street, Peoria, Ill. 61629. The apparatus 11 further includes an arm 15 having a first side member 17 with a proximal end 19 pivotally attached to the tractor 13 and a distal end 21, having a second side member 23 with a proximal end 25 pivotally attached to the tractor 13 and a distal end 27, and a front member 29 joining the distal ends 21, 27 of the first and second side members 17, 23. The apparatus 11 further includes means 31 for moving the arm 15 between raised and lowered positions. The means 31 preferably consist of a typical hydraulic piston system well known to those skilled in the art. The arm 15 and means 31 may be standard or optional equipment of the tractor and is preferably obtained with the tractor, such as the model D-8 bulldozer manufactured by Caterpillar Inc., 100 N.E. Adams Street, Peoria, Ill. 61629.

The apparatus 11 further includes a driving platform 33 attached to the front member 29 of the arm 15 for engaging and pressing a pile or pile segment into the unstable soil S when the means 31 for moving the arm 15 between raised and lowered positions moves the arm 15 from the raised position to the lowered position. The driving platform 33 may be fabricated of steel plates or the like with a relatively flat underside 35, and pivotally attached to the center of the front member 29 of the arm 15 by a U-joint pivot means 37 or the like so as to pivot 360 degrees vertically and horizontally.

The apparatus 11 further includes an auxiliary weight 39 attached, either directly or indirectly, to the front member 29 of the arm 15, preferably substantially centered between the side members 17, 23. The auxiliary weight 39 may be of any form or construction now apparent to those skilled in the art and is preferably approximately 50,000 pounds (22,679.62 kilograms).

The method includes the steps of providing the tractor 13; the arm 15; the means 31 for moving the arm 15 between the raised and lowered positions; the driving platform 33; and the auxiliary weight 39. The method also includes the steps of providing a starter pile 41 having a first or lower end 43 and a second or upper end 45; placing the first end 43 of the starter pile 41 on the unstable soil US; positioning the driving platform 33 on the second end 45 of the starter pile 41; and then activating the means 31 for moving the arm 15 between raised and lowered positions to move the arm 15 to the lowered position and cause the driving platform 33 to drive the starter pile 41 into the unstable soil US.

Figure 4:
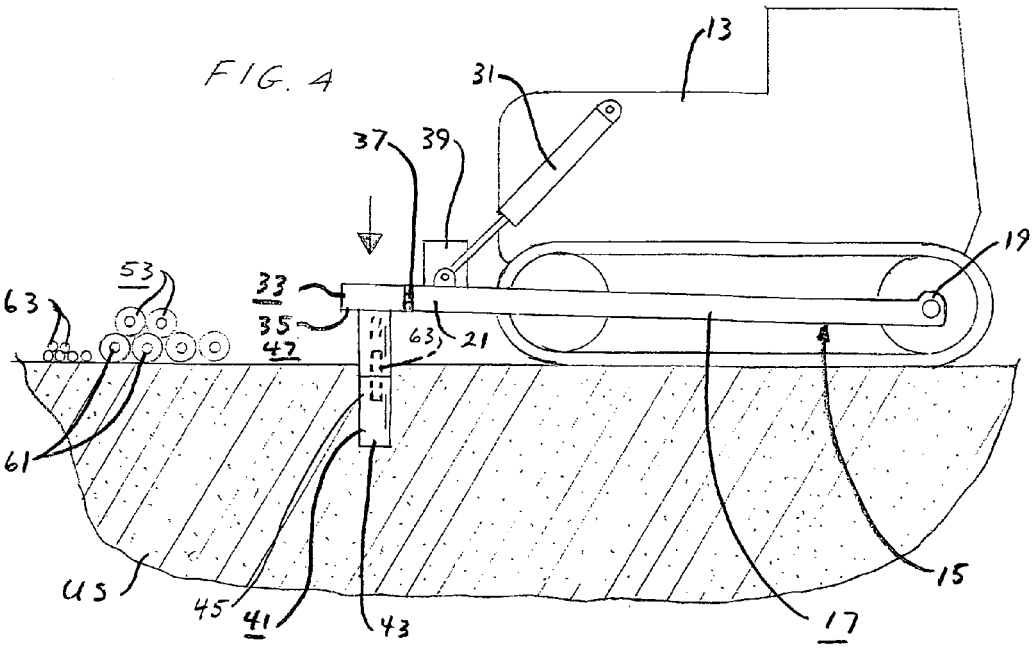
FIG. 4 is a cross-sectional view similar to FIG. 3 but illustrating a further step of the method of the present invention.

The method preferably includes the additional steps of providing a secondary or follower pile 47 having a first or lower end 49 and a second or upper end 51; placing the first end 49 of the secondary pile 47 on the second end 45 of the starter pile 41 (see FIG. 3); positioning the driving platform 33 on the second end 51 of the secondary pile 47; and then activating the means 31 for moving the arm 15 between raised and lowered positions to move the arm 15 to the lowered position and cause the driving platform 33 to drive the secondary pile 47 into the unstable soil US and drive the starter pile 41 further into the unstable soil US (see FIG. 4).

Figure 5:
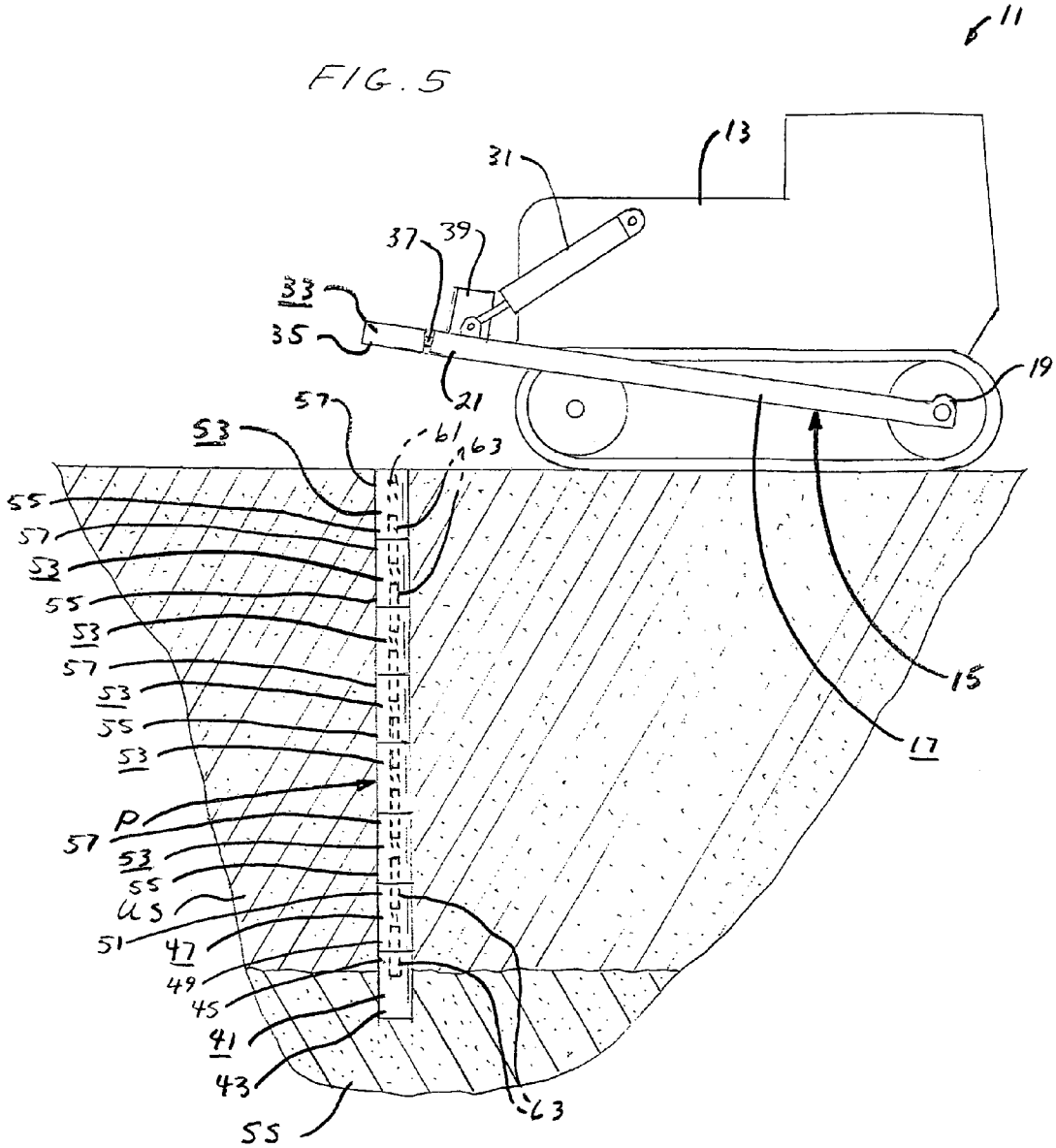
FIG. 5 is a cross-sectional view similar to FIG. 4 but illustrating a further step of the method of the present invention.
Figure 6:
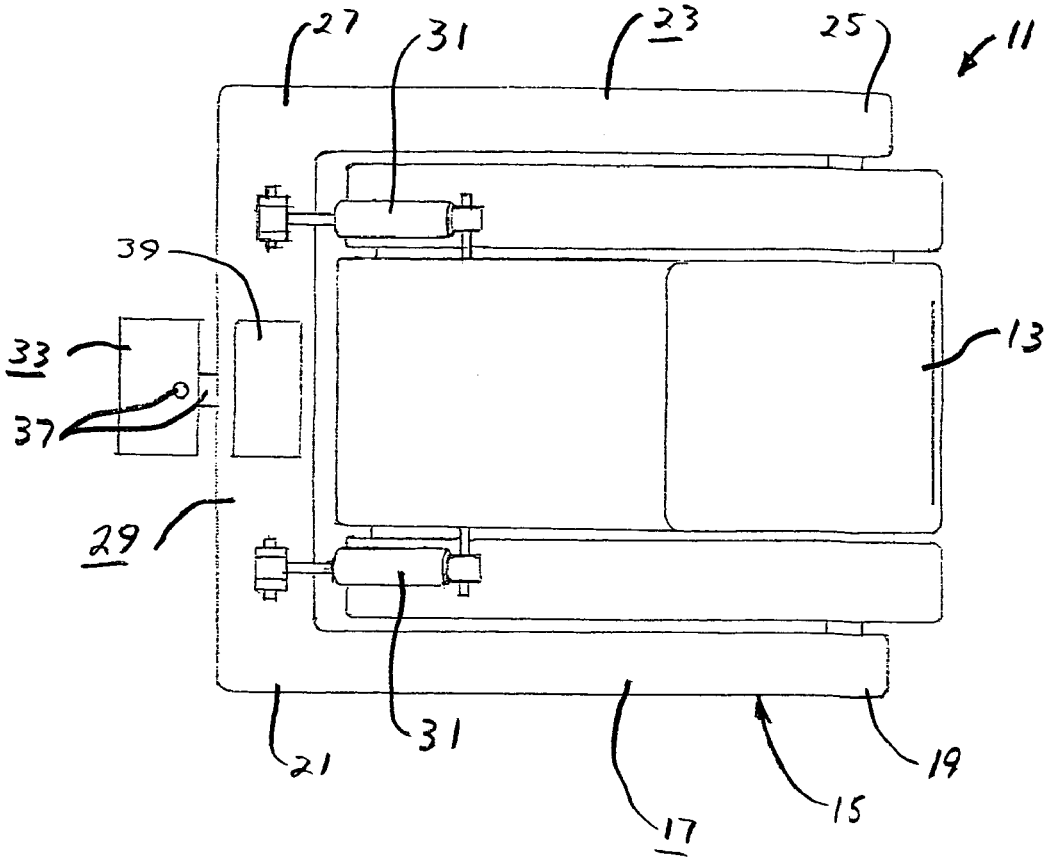
FIG. 6 is a somewhat diagrammatic top plan view of the apparatus of the present invention.

The method may include the additional steps of providing a plurality of supplemental secondary or follower piles 53 for coacting with the starter pile 41 and secondary pile 47 to form an elongated pile P (see FIG. 5). Each supplemental pile 53 has a first or lower end 55, a second or upper end 57. The method thus includes the steps of placing the first end 55 of a first supplemental pile 53 on the second end 51 of the secondary pile 47; positioning the driving platform 33 on the second end 57 the first supplemental pile 53; and then activating the means 31 for moving the arm 15 between raised and lowered positions to move the arm 15 to the lowered position and cause the driving platform 33 to drive the first supplemental pile 53 into the unstable soil US and thus drive the starter pile 41 and secondary pile 47 further into the unstable soil US. That process may then be repeated with successive supplemental piles 53 until the starter pile 41 reaches stable soil SS as illustrated in FIG. 5.

Each pile 41, 47, 53 has a longitudinal axis extending between the first and second ends thereof, and an aperture 61 extending along the longitudinal axis. The aperture 61 preferably extends only halfway from the second end 45 toward the first end 43 of the starter pile 41, but preferably extends completely through the secondary and supplemental piles 47, 53. Each pile 41, 47, 53 may be constructed in various manners, out of various materials (e.g., concrete, polymer, etc.) and in various sizes and designs as will now be apparent to those skilled in the art. Thus, for example, each pile 41, 47, 53 is preferably cast or otherwise constructed as a one-piece, integral unit out of standard 7000 psi (pounds per square inch) concrete as a right cylinder approximately 12 inches (30.48 centimeters) in length and approximately 6 inches (15.24 centimeters) in diameter with the aperture 61 being approximately 0.625 inches (1.5875 centimeters) in diameter (i.e., no greater than 17% of the outside diameter of the pile 41, 47, 53).

The method may include providing at least one and preferably a plurality of connecting rods 63, with each connecting rod 63 provided for extending between and axially aligning an adjacent pair of piles 41, 47, 53. Thus, the method may include inserting the first end of a first connecting rod 63 into the aperture 61 in the second end 45 of the starter pile 41 after the starter pile 41 has been driven into the unstable soil US; then placing the first end 49 of the secondary (first follower) pile 47 onto the second end 45 of the starter pile 41 with the second end of the first connecting rod 63 extending into the aperture 61 in the first end 49 of the secondary pile 47; then driving that starter pile 41/secondary pile 47 construct into the unstable soil US with the apparatus 11; then inserting the first end of a second connecting rod 63 into the aperture 61 in the second end 51 of the secondary pile 47; then placing the first end 55 of a first supplemental (second follower) pile 53 onto the second end 51 of the secondary pile 47 with the second end of the second connecting rod 63 extending into the aperture 61 in the first end 55 of the first supplemental pile 53; then driving that starter pile 41/secondary pile 47/first supplemental pile 53 construct into the unstable soil US with the apparatus 11; then, if necessary, inserting the first end of a third connecting rod 63 into the aperture 61 in the second end 57 of the first supplemental pile 53; then placing the first end 55 of a second supplemental (third follower) pile 53 onto the second end 57 of the first supplemental pile 53 with the second end of the third connecting rod 63 extending into the aperture 61 in the first end 55 of the second supplemental pile 53; then driving that starter pile 41/secondary pile 47/first supplemental pile 53/second supplemental pile construct into the unstable soil US with the apparatus 11; and then continuing with additional supplemental piles 53 and connecting rods 63 until the elongated pile P reaches stable soil SS or otherwise reaches the desired depth.

Each connecting rod 63 is preferably identical to one another and may be constructed in various manners, out of various materials (e.g., steel, polymer, etc.) and in various sizes and designs as will now be apparent to those skilled in the art. Thus, for example, each connecting rod 63 is preferably cut or otherwise formed out of substantially rigid steel rod as a one-piece, integral unit approximately 12 inches (30.48 centimeters) in length and approximately 0.625 inches (1.5875 centimeters) in diameter so as to fit into the apertures 61 in the piles 41, 47, 53 with the lower half of the length of each connecting rod 63 extending into the aperture 61 in the upper end 45, 51, 57 of a lower pile 41, 47, 53 and with the upper half of the length of each connecting rod 63 extending into the aperture 61 in the lower end 49, 55 of a pile 47, 53.

Although the present invention has been described and illustrated with respect to preferred embodiments and preferred uses therefor, it is not to be so limited since modifications and changes can be made therein which are within the full intended scope of the invention.

What is claimed is:

1. An apparatus for installing a pile in unstable soil before a building foundation is installed on that unstable soil; said apparatus comprising:

(a) a tractor;

(b) an arm having a first side member with a proximal end pivotally attached to said tractor and a distal end, having a second side member with a proximal end pivotally attached to said tractor and a distal end, and a front member joining said distal ends of said first and second side members;

(c) means for moving said arm between raised and lowered positions;

(d) a driving platform attached to said front member of said arm for engaging and pressing the pile into the unstable soil when said means for moving said arm between raised and lowered positions moves said arm from said raised position to said lowered position; and (e) auxiliary weight attached to said front member of said arm.

2. The apparatus of claim 1 in which said auxiliary weight is approximately 50,000 pounds (22,679.62 kilograms).

3. A method of installing a pile in unstable soil before a building foundation is installed on that unstable soil; said method comprising the steps of:

(a) providing a tractor; an arm pivotally attached to said tractor; means for moving said arm between raised and lowered positions; a driving platform attached to said arm; and auxiliary weight attached to a front member of said arm;

(b) providing a starter pile having first end and a second end;

(c) placing said first end of said starter pile on the unstable soil;

(d) positioning said driving platform on said second end of said starter pile; and (e) activating said means for moving said arm between raised and lowered positions to move said arm to said lowered position and cause said driving platform to drive said starter pile into the unstable soil.

4. The method of claim 3 in which is included the additional steps of:

(a) providing a secondary pile having a first end and a second end;

(b) placing said first end of said secondary pile on said second end of said starter pile;

(c) positioning said driving platform on said second end of said secondary pile; and (d) activating said means for moving said arm between raised and lowered positions to move said arm to said lowered position and cause said driving platform to drive said secondary pile into the unstable soil and drive said starter pile further into the unstable soil.

5. The method of claim 3 in which said auxiliary weight is approximately 50,000 pounds (22,679.62 kilograms).

6. A method of installing a segmented piling system in unstable soil before a building foundation is installed on that unstable soil; said method comprising the steps of:

(a) providing a tractor; an arm pivotally attached to said tractor; means for moving said arm between raised and lowered positions; a driving platform attached to said arm; and auxiliary weight attached to a front member of said arm;

(b) providing a starter pile having a first end, a second end, a longitudinal axis extending between said first and second ends, and an aperture in said second end extending along said longitudinal axis; the inside diameter of said aperture in said second end of said starter pile being no greater than 17% of the outside diameter of said starter pile;

(c) positioning said driving platform on said second end of said starter pile;

(d) activating said means for moving said arm between raised and lowered positions to move said arm to said lowered position and cause said driving platform to drive said starter pile into the unstable soil;

(e) providing a first connecting rod having a first end and a second end;

(f) inserting said first end of said connecting rod into said aperture in said second end of said starter pile;

(g) providing a first follower pile having a first end, a second end, a longitudinal axis extending between said first and second ends, and an aperture in said first end extending along said longitudinal axis; the inside diameter of said aperture in said first end of said first follower pile being no greater than 17% of the outside diameter of said first follower pile;

(h) placing said first end of said first follower pile onto said second end of said starter pile with said second end of said first connecting rod extending into said aperture in said first end of said first follower pile;

(g) positioning said driving platform on said second end of said first follower pile; and (h) then activating said means for moving said arm between raised and lowered positions to move said arm to said lowered position and cause said driving platform to drive said first follower pile into the unstable soil and drive said starter pile further into the unstable soil.

7. The method of claim 6 in which said first follower pile has an aperture in said second end thereof extending along said longitudinal axis thereof, the inside diameter of said aperture in said second end of said first follower pile being no greater than 17% of the outside diameter of said first follower pile; and in which said method further comprising the steps of:

(a) providing a second follower pile having a first end, a second end, a longitudinal axis extending between said first and second ends, and an aperture in said first end extending along said longitudinal axis; the inside diameter of said aperture in said first end of said second follower pile being no greater than 17% of the outside diameter of said second follower pile;

(b) providing second connecting rod having a first end and a second end;

(c) inserting said first end of said second connecting rod into said aperture in said second end of said first follower pile;

(d) placing said first end of said second follower pile onto said second end of said first follower pile with said second end of said second connecting rod extending into said aperture in said first end of said second follower pile;

(e) positioning said driving platform on said second end of said second follower pile; and (f) then activating said means for moving said arm between raised and lowered positions to move said arm to said lowered position and cause said driving platform to drive said second follower pile into the unstable soil and drive said first follower pile and said starter pile further into the unstable soil.

8. The method of claim 6 in which said auxiliary weight is approximately 50,000 pounds (22,679.62 kilograms).

* * * * *